United States Patent [19]

Heinrich

[11] 4,129,986

[45] Dec. 19, 1978

[54] METHOD OF AND MEANS FOR PREVENTING THERMAL SHOCK TO A HYDRAULIC MOTOR IN AN OPEN-LOOP HYDRAULIC SYSTEM

[75] Inventor: Allan E. Heinrich, Oconomowoc, Wis.

[73] Assignee: Dynex/Rivett Inc., Pewaukee, Wis.

[21] Appl. No.: 815,455

[22] Filed: Jul. 13, 1977

[51] Int. Cl.[2] ..... F15B 21/04

[52] U.S. Cl. ..... 60/327; 60/329; 60/456; 418/83

[58] Field of Search ..... 60/327, 329, 456, 494; 126/247; 91/419; 418/83, 1

[56] References Cited

U.S. PATENT DOCUMENTS

| | | | |
|---|---|---|---|
| 2,659,204 | 11/1953 | Conway et al. | 60/329 |
| 2,721,447 | 10/1955 | Hancock | 60/329 |
| 2,764,147 | 9/1956 | Brunner | 126/247 |
| 2,984,985 | 5/1961 | MacMillin | 60/471 |

*Primary Examiner*—Edgar W. Geoghegan

*Attorney, Agent, or Firm*—John J. Byrne; Edward E. Dyson

[57] ABSTRACT

Disclosed is a method of preventing thermal shock to a hydraulic motor in an open-loop hydraulic system. The method comprises the step of circulating warm oil through the motor when it is not in use. Preferably the method includes the further step of returning the warm oil to the tank after it has passed through the motor, and where appropriate it may also include the preliminary step of lowering the pressure of the warm oil before it is passed through the motor.

The method is disclosed as applied to a vane motor, and means for carrying it out in that context are also disclosed.

10 Claims, 3 Drawing Figures

METHOD OF AND MEANS FOR PREVENTING THERMAL SHOCK TO A HYDRAULIC MOTOR IN AN OPEN-LOOP HYDRAULIC SYSTEM

BACKGROUND OF THE INVENTION

This invention relates to open-loop hydraulic systems comprising a tank, a pump, at least one directional control valve, and a hydraulic motor. In such systems, the operating fluid (which is normally oil) is drawn from the tank by the pump, flows through the pump, at least one directional control valve, and, in certain states of the circuit, the hydraulic motor, and returns to the tank.

In open-loop hydraulic systems, it is common to warm up the oil in the hydraulic system before the system is actually used. However, the warm up is limited to the oil, the pump, and one passage in the directional control valve (or valves, if the system is of the "high pressure carry-over" type). Other components in the circuit, such as motors, actuators, and other valves, are left cold.

When a directional control valve is shifted, the warm oil in the hydraulic system flows through a cold motor or other component, causing thermal shock. The result is nonuniform expansion of the internal parts of the motor or other component. Galling and component failure may occur. Motors manufactured with small running clearance for efficient operation (such as vane motors) are particularly susceptible to damage from thermal shock, and thermal shock has been a recurring problem where vane motors are used on machines subject to cold ambient temperatures, such as some oil well drilling rigs.

OBJECTS OF THE INVENTION

It is, therefore, a general object of the invention to obviate or minimize problems of the type previously described.

It is a particular object of the invention to prevent or minimize thermal shock to hydraulic motor in open-loop hydraulic system.

It is a further object of the invention to prevent or minimize thermal shock to hydraulic motors manufactured with small running clearances (such as vane motors).

Other objects and advantages of the present invention will become apparent from the following detailed description of a preferred embodiment taken in conjunction with the accompanying drawings.

DETAILED DESCRIPTION OF THE PRESENTLY PREFERRED EMBODIMENT

The basic idea behind the present invention is to circulate warm oil from the circuit through the motor when it is not in use. In most cases a minor modification of the motor and a simple addition to the hydraulic circuit are all that are required to provide the necessary circulation.

Each circuit must be studied to determine the best source of consistently warm oil. If several functions operate independently, a review of the normal operating procedure may be necessary to locate the best source of warm-up oil. Usually oil at low pressure is most desirable for the warm-up function, and, if the best source of warm oil contains oil at a high pressure, means for lowering the pressure of the warm oil before it is passed through the motor are preferably provided.

Figure 1:
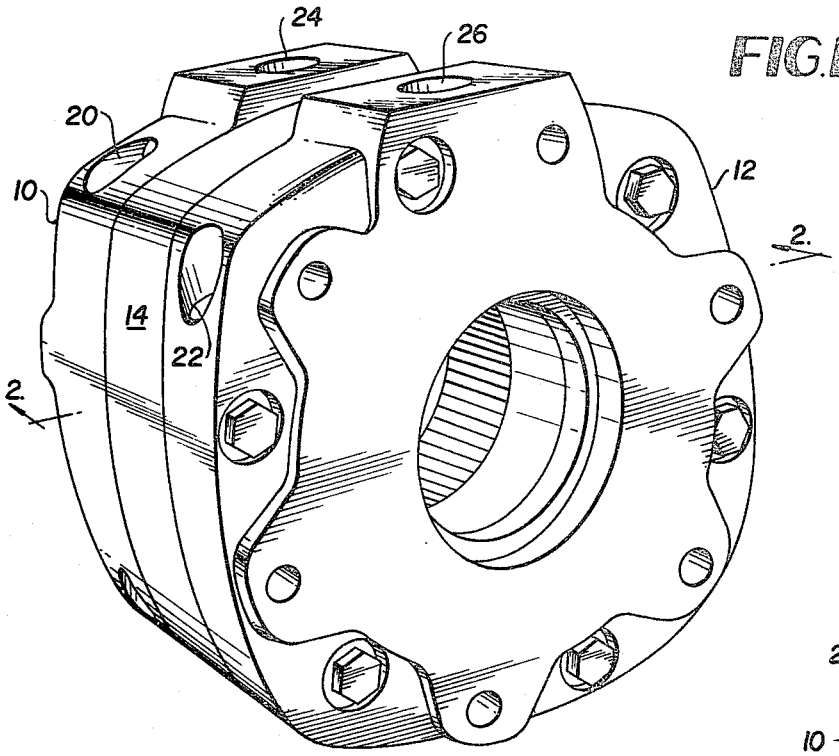
FIG. 1 is a perspective view of a vane motor incorporating the subject invention.
Figure 2:
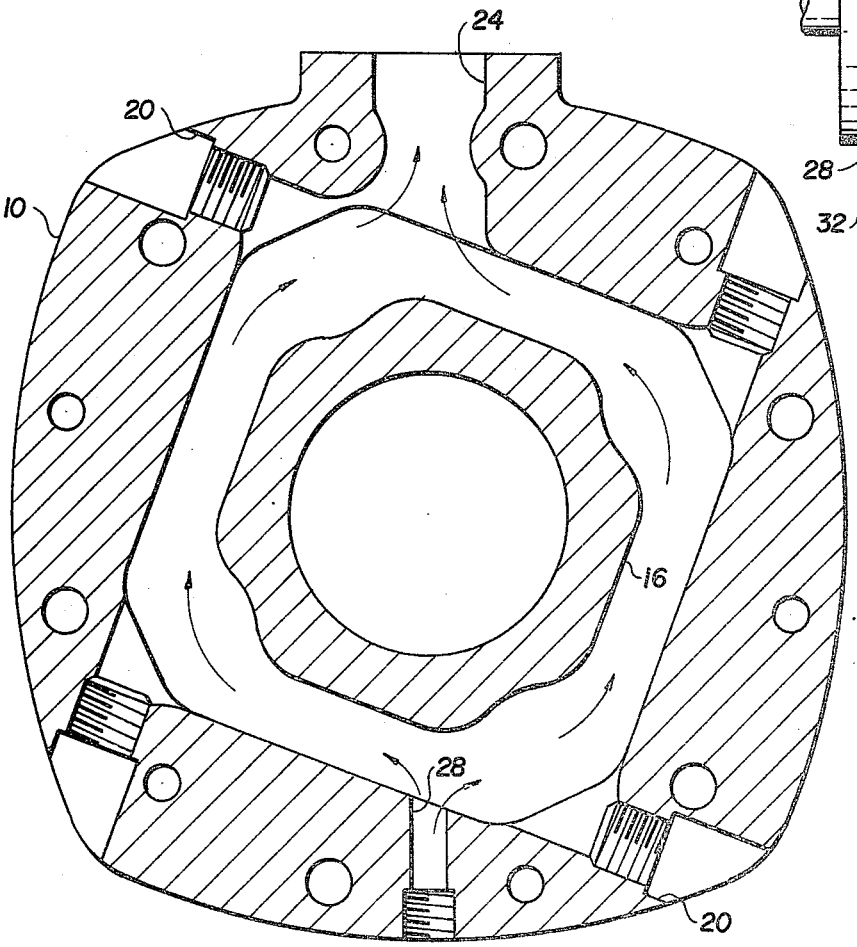
FIG. 2 is a sectional view of a plane including the line 2—2 in FIG. 1.

FIGS. 1 and 2 show an otherwise conventional vane motor incorporating the subject invention. Such motors comprise end covers 10 and 12 and a cam and motor housing 14 containing a rotor 16 mounted on a shaft 18. In use, oil is pumped into port 26 and out port 24 and back to tank (not shown). For opposite rotation, oil is pumped into port 24 and out of port 26.

Figure 3:
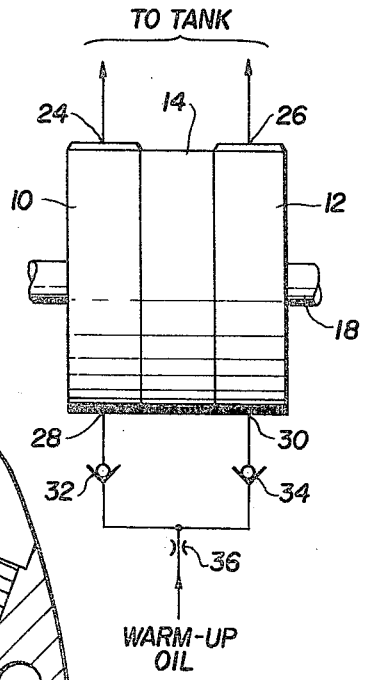
FIG. 3 is a fluid circuit diagram showing the application of the subject invention to a vane motor.

According to the subject invention, additional inlet ports 28, 30 (the latter being shown only in FIG. 3) are machined into the end covers 10, 12 as input ports for the warm-up oil, and a check valve 32, 34 (shown only in FIG. 3) is provided for each inlet port 28, 30. The check valves 32, 34 allow warm-up oil to enter the end covers 10, 12 when the motor is not working (at which time both end covers are at tank pressure), but they prevent oil from back flowing out of the relevant one of the inlet ports 28, 30 when the motor is working and one end cover is receiving high pressure oil. The check valves 32, 34 can be installed in each warm-up input line, as shown, or they can be built directly into the end covers 10, 12. Additionaly, a restricter 36 is provided in the input line of the illustrated embodiment to lower the pressure of the warm oil before it is passed through the motor. As previously explained, the restricter 36 is not always necessary, but may be advantageously provided in certain circuits.

In many circuits, when the motor is not working, the motor directional valve is in a position where both outlet ports 24, 26 are connected to the tank. In such a circuit, the warm-up oil can pass as illustrated through the end covers 10, 12 and flow back to the tank through the outlet ports 24, 26. If, however, the circuit is such that the outlet ports are not connected to tank when the motor is not working, then an additional outlet port (not shown) may be machined into each end cover opposite the inlet ports 28, 30 as output ports for the warm-up oil.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. A method of preventing thermal shock to a hydraulic vane motor in an open-loop hydraulic system comprising a tank, a pump, at least one directional control valve, and the hydraulic vane motor, said hydraulic vane motor comprising a cam and motor housing containing a rotor mounted on a shaft, said housing having end cover portions, said method comprising the step of continuously circulating warm oil from a source of consistently warm oil through the end cover portions of the hydraulic vane motor when it is not in use.

2. A method as recited in claim 1 and including the further step of returning the warm oil to the tank after it has passed through the motor.

3. A method as recited in claim 1 and including the further step of lowering the pressure of the warm oil before it is passed through the motor.

4. A method as recited in claim 1 and including the further step of preventing back flow of the warm oil.

5. An open-loop hydraulic system comprising:

(a) a tank, (b) a pump, (c) at least one directional control valve, (d) a hydraulic vane motor comprising a cam and motor housing containing a rotor mounted on a shaft, said housing having end cover portions and (e) means for continuously circulating warm oil from a source of consistently warm oil through the end cover portions of said hydraulic vane motor when it is not in use, thereby preventing thermal shock to said motor.

6. An open-loop hydraulic system as recited in claim 5 and further comprising means for returning the warm oil to said tank after it has passed through said motor.

7. An open-loop hydraulic system as recited in claim 5 and further comprising means for lowering the pressure of the warm oil before it is passed through said motor.

8. An open-loop hydraulic system as recited in claim 5 and further comprising means for preventing back flow of the warm oil.

9. A method of preventing thermal shock to a hydraulic rotary motor in an open-loop hydraulic system comprising a tank, a pump, at least one directional control valve, and the hydraulic rotary motor, said hydraulic motor comprising a motor housing and a rotor disposed within said motor housing such that there is a small running clearance between said motor housing and said rotor said method comprising the step of continuously circulating warm oil from a source of consistently warm oil through said motor when it is not in use.

10. An open-loop hydraulic system comprising:

(a) a tank;

(b) a pump;

(c) at least one directional control valve;

(d) a hydraulic rotary motor comprising a motor housing and a rotor disposed within said motor housing such that there is a small running clearance between said motor housing and said rotor; and (e) means for continuously circulating warm oil from a source of consistently warm oil through said hydraulic motor when it is not in use, thereby preventing thermal shock to said motor.

* * * * *